US006817402B1

(12) United States Patent
Fraczek et al.

(10) Patent No.: US 6,817,402 B1
(45) Date of Patent: Nov. 16, 2004

(54) UNIVERSAL BRACKETING AND CAP SYSTEM FOR MULTIPLE CASSETTE ROLLER SHADE

(75) Inventors: Richard Fraczek, Stamford, CT (US); David M. Cross, Westport, CT (US); Jeffrey Ausfeld, New York, NY (US)

(73) Assignee: Rollease, Inc., Stamford, CT (US)

( * ) Notice: Subject to any disclaimer, the term of this patent is extended or adjusted under 35 U.S.C. 154(b) by 0 days.

(21) Appl. No.: 10/391,003

(22) Filed: Mar. 18, 2003

Related U.S. Application Data

(60) Provisional application No. 60/366,318, filed on Mar. 21, 2002.

(51) Int. Cl.[7] ..... A47G 5/02

(52) U.S. Cl. ..... 160/323.1; 248/267

(58) Field of Search ..... 160/321, 326, 160/23.1, 24, 323.1, 120, 241; 248/266, 267

(56) References Cited

U.S. PATENT DOCUMENTS 1,545,160 A * 7/1925 Myers ..... 248/266
4,122,559 A * 10/1978 Kelly ..... 4/608
4,231,411 A * 11/1980 Hehl et al. ..... 160/120
4,372,432 A 2/1983 Waine et al.
4,433,765 A 2/1984 Rude et al.
5,975,186 A * 11/1999 Day ..... 160/321
6,173,825 B1 * 1/2001 Liu ..... 192/223.4
6,457,688 B1 * 10/2002 Welfonder ..... 248/266
6,499,709 B1 * 12/2002 Parent ..... 248/267
6,532,109 B1 * 3/2003 Shopp ..... 359/461

* cited by examiner

*Primary Examiner*—Blair M. Johnson
(74) *Attorney, Agent, or Firm*—Jeffrey M. Kaden, Esq.; Gottlieb, Rackman & Reisman, P.C.

(57) ABSTRACT

A cassette system for window treatment includes a head rail with a base, end brackets attached to the base in a facing relationship and at least one roller blind with a mandrel and a decorative panel that is wound on the mandrel. The panel can be selectively drawn off the mandrel by rotation thereof. The end brackets are identical and mate with end plugs on the mandrel to rotationally support the roller blind. In an alternate embodiment, two or more roller blinds are supported by intermediate brackets or by an intermediate bracket and an end bracket. The end plugs on the madrel(s) have identical shapes to mate with respective legs on the end brackets.

24 Claims, 5 Drawing Sheets

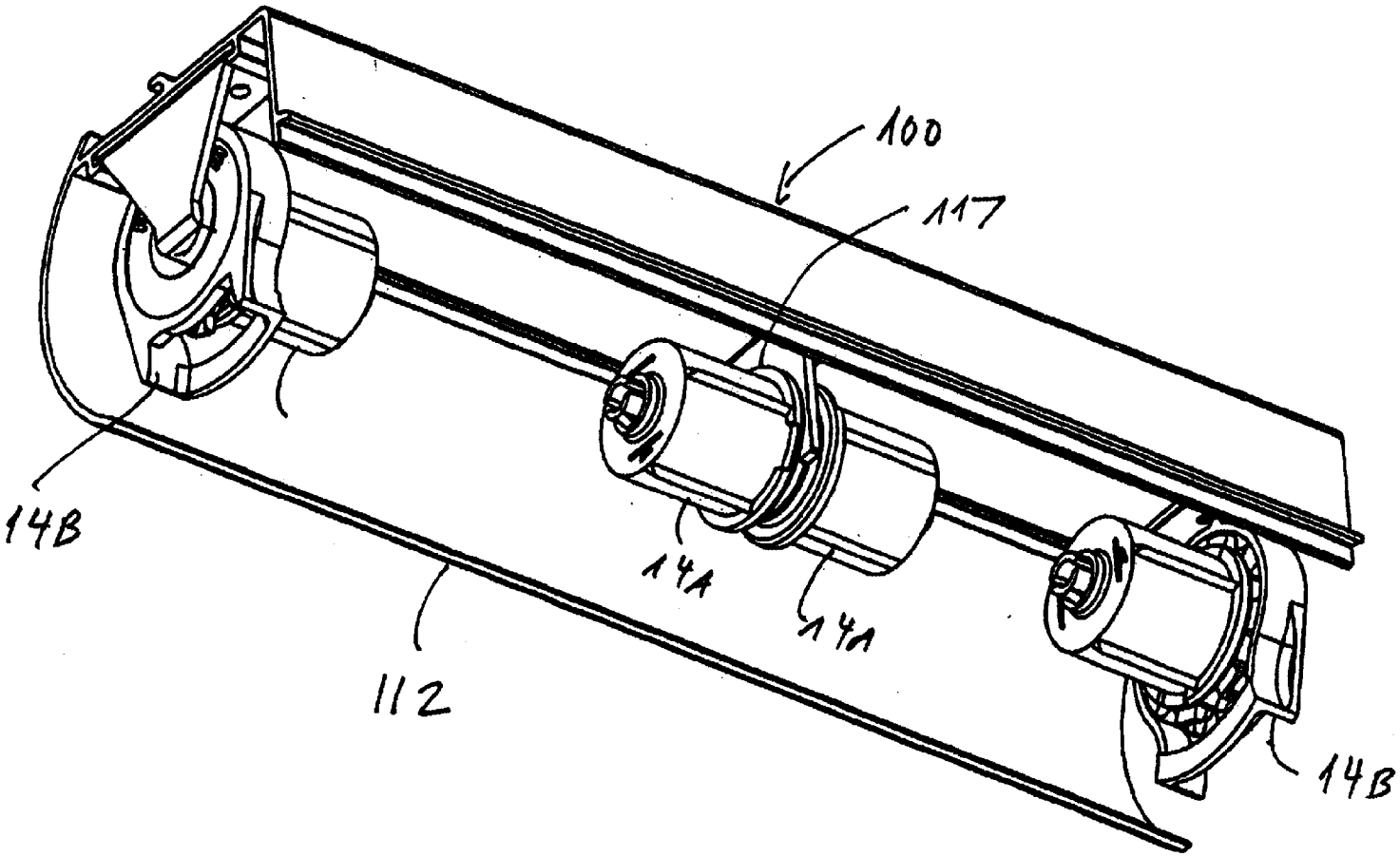
Fig# 4a

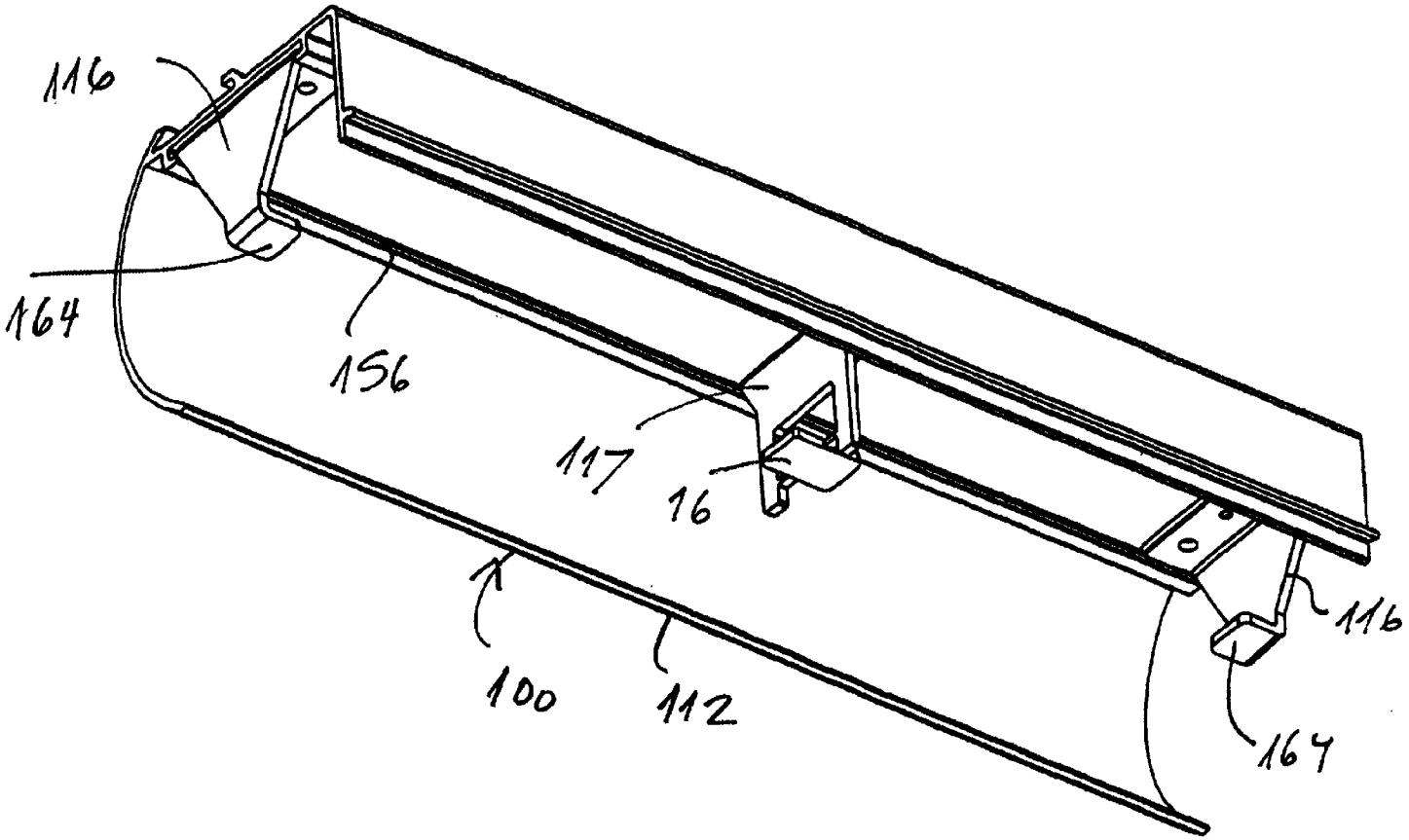
Fig #4b

UNIVERSAL BRACKETING AND CAP SYSTEM FOR MULTIPLE CASSETTE ROLLER SHADE

RELATED APPLICATIONS

This application claims priority to provisional application Ser. No. 60/366,318 filed Mar. 21, 2002 entitled UNIVERSAL BRACKETING AND CAP SYSTEM FOR CASSETTE ROLLER SHADE and incorporated herein by reference.

BACKGROUND OF THE INVENTION

1. Field of Invention

This invention pertains to a cassette system for window shades and more particularly to a system that incorporates a roller blind supported by two identical brackets. The cassette system can accommodate one panel that can be deployed by a user in the conventional manner, or can include axially spaced end panels, each panel each panel being deployed independently.

2. Description of the Prior Art

There are several types of window dressings that can be used to cover windows. One of the most popular types of window dressings are roller blinds. Typically, roller blinds consist of a cylindrical mandrel holding a decorative panel of fabric, plastic or other pliable material. The cylindrical mandrel is formed with a clutch on one side, a pin on the other, and supported by two brackets on each side. The end of the mandrel supported at the pin is freely rotatable. The clutch allows the mandrel to rotate in a controlled manner to allow selectively the raising or lowering of the panel. A control mechanism may,be interfaced with the clutch to allow a customer to operate the roller blind, using a chain or a rope.

The simplest roller blinds consist only of the mandrel and the panel, and two end brackets. More advanced blind rollers are contained in cassette housings. The cassettes provide a decorative housing that hides the roller blind (except for the panel), the associated hardware, and can be mounted in a window frame using a variety of mounting fixtures depending on the orientation.

Two different cassette systems with roller blinds are known. In one system, the cassettes are provided with roller blinds having a clutch at one end and a pin at the other, as discussed above, with a specific end-cap provided for each type of bracket. Systems of this type are available, for example, from Multifilm of Cuneo, Italy, Arquati of Carrolton, Tex. and Sala Baganza (Parma) Italy. This arrangement has several disadvantages. One disadvantage is that customers demand the ability to install the cassettes with the control mechanism, including the clutch on either the right or the left side of the window. As a result, the cassette systems had to be made with four different types of brackets: two types for a left clutch and a right pin; and two additional types, one for a right clutch and one for a left pin. Yet another disadvantage is that there are several types of clutches are available, and a different type of bracket must be provided for each type of clutch mechanism.

Another disadvantage on the manufacturing side is that end caps of these types require complex and expensive tooling, frequently running up to $50,000.

Another type of cassette system presently available requires separate end brackets that must be mounted in the window frame and attached to a rail by a screw and finished with a protective cover attached to the bracket. This type of system is available, for example, from Benthin Systems of Germany. Its main disadvantage is that the bracket and its cover add to the cost of the system and are esthetically undesirable.

In addition, both systems described above tend to be difficult to assemble.

U.S. Pat. Nos. 4,372,432 and 4,433,765 disclose clutch assemblies that are used for roller blinds and other similar devices.

SUMMARY OF THE INVENTION

According to this invention, a window treatment cassette system includes a head rail with a base, two preferably identical end brackets mounted in the base and a roller blind supported between the brackets. The blind roller includes two end plugs: one for the pin end and one for the clutch. The end plugs are formed on the external surface of the roller with identical slots adapted to receive the respective leg of each supporting bracket. In this manner, the blind roller can be mounted with the clutch plug end on the left or the right, thereby allowing the blind roller to be operated from either side.

In an alternate embodiment, the cassette system is provided with a plurality of roller blinds of various lengths, each roller blind supported either between two intermediate brackets or an intermediate bracket and an end bracket.

DETAILED DESCRIPTION OF THE PREFERRED EMBODIMENTS

Figure 1:
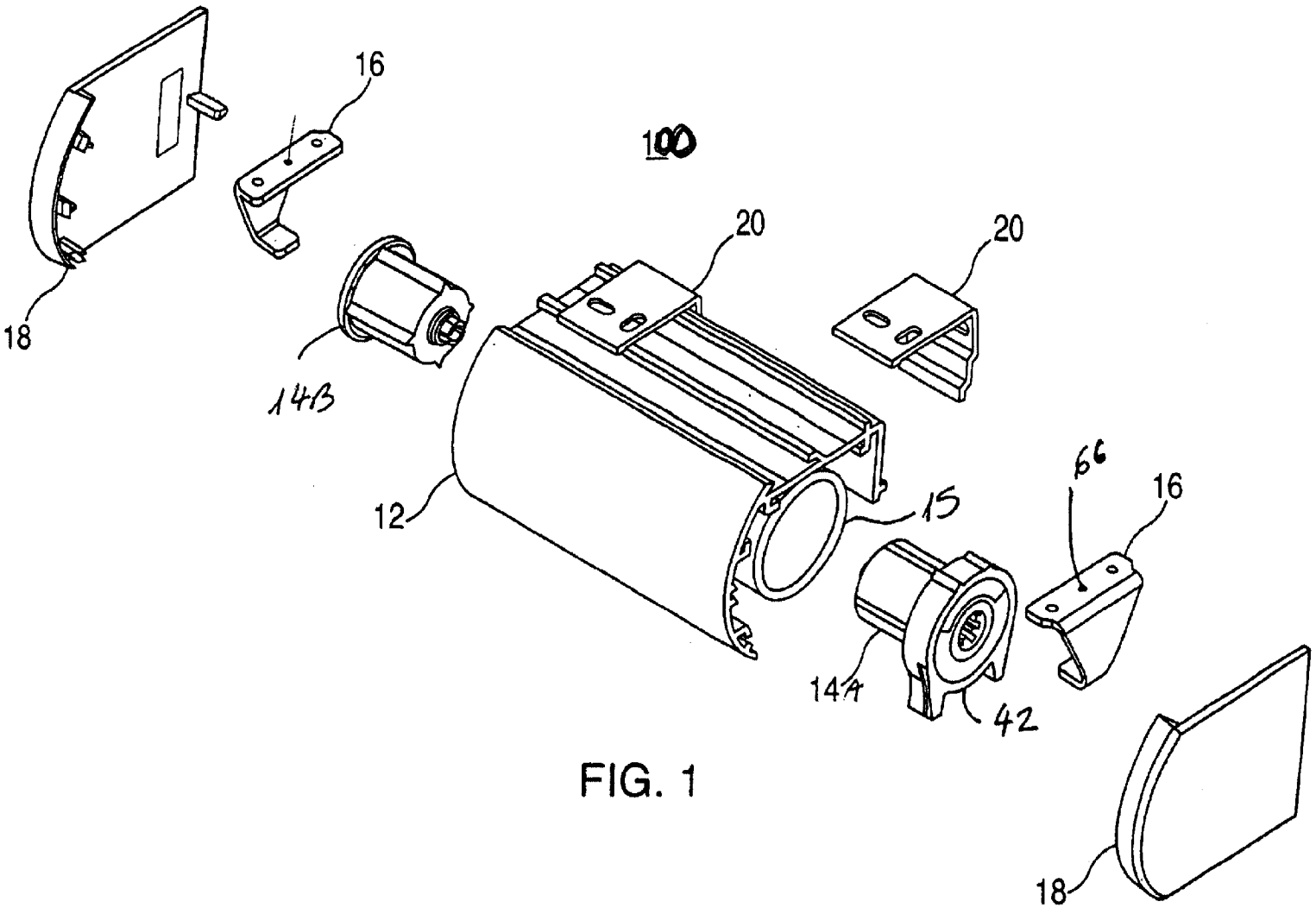
FIG. 1 shows an exploded view of a cassette system constructed in accordance with the subject invention for a single roller blind.
Figure 1A:
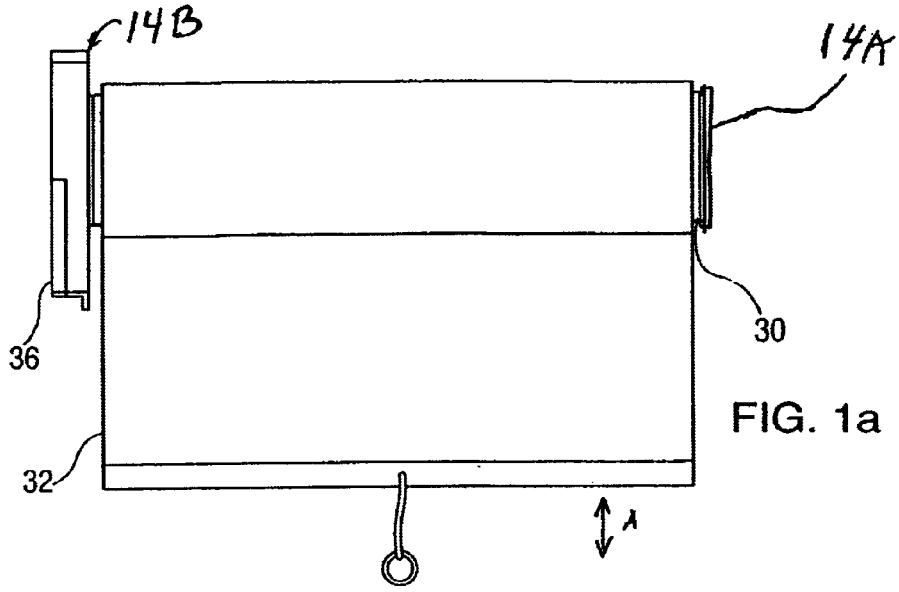
FIG. 1*a* shows a front elevational view of the roller blind used in the cassette system of FIG. 1.
Figure 1B:
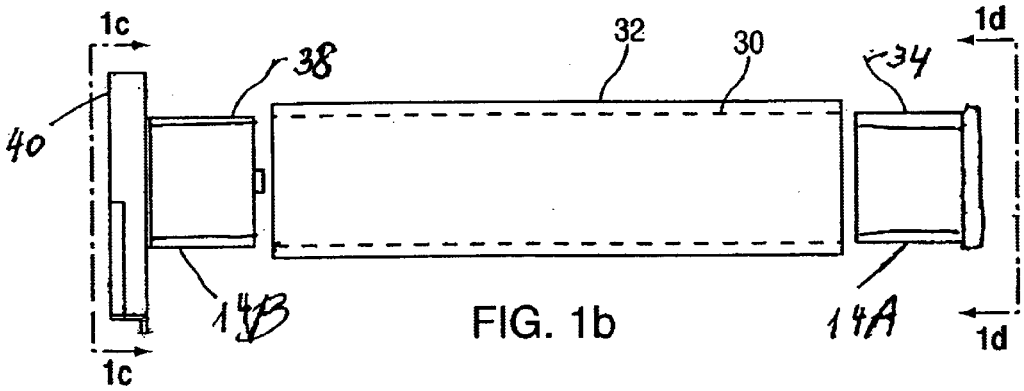
FIG. 1*b* shows a front elevational exploded view of the cassette system of FIG. 1A.

Referring first to FIGS. 1 and 1*a*-1*d*, a cassette system 100 constructed in accordance with this invention includes a head rail 12, two end plugs 14A, 14B, a roller blind 15, two end brackets 16 and two end caps 18. The end brackets are mounted on the head rail. The end plugs 14A, 14B are inserted telescopically into the roller blind 15 and are supported by the end brackets. The cassette system 100 can be secured to the frame of a window or other similar fixture (not shown) by two or more clips 20 that engage the head rail 12.

The roller blind 15 includes a hollow mandrel 30 with a panel 32 wound on the mandrel 30. Rotating the mandrel 30 in one direction causes the panel 32 to wind up onto the mandrel 30 while rotating the mandrel 30 in the opposite direction causes the panel 32 to wind down, as indicated by arrow A.

The ends of the mandrel 30 are hollow to receive end plugs 14A (shown as an idler) and 14B (shown as a clutch), respectively. (In fact, the whole mandrel is typically hollow.) End plug 14A consists of a drum 34 and a bushing 36 rotatably inserted into the drum 36. End plug 14B is formed with a drum 38 and a capstan 40. Drums 34, 38 are inserted into the opposite ends of mandrel 30 and are maintained therein by interference fit or by other well known means.

The drum 38 includes a clutch (not shown). Capstan 40 includes an opening 42 through which a rope (not shown) such as, for example, a cord or bead chain, can pass through. Within the capstan, the rope passes over a wheel 44 and then exits through opening 42. Pulling one end of the rope causes the wheel to rotate in one direction. This motion is transmitted to the clutch which then rotates the drum 38 and mandrel 30. Pulling the other end of the rope causes the mandrel 30 to rotate in the opposite direction. This whole mechanism is well known in the art, as described for example, in U.S. Pat. No. 4,372,432 incorporated herein by reference.

Figure 1C:
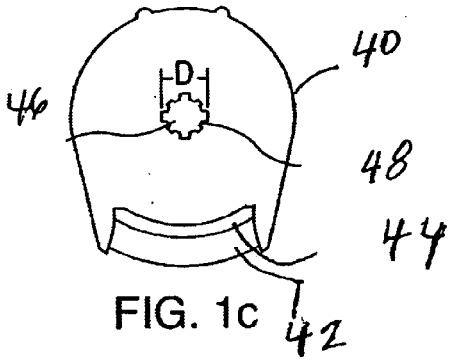
FIG. 1*c* shows a side elevational view of a clutch plug of the cassette system of FIGS. 1*a*, 1*b;*
Figure 1D:
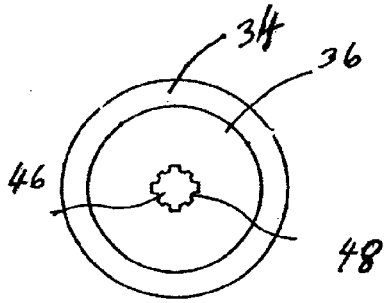
FIG. 1*d* shows a side elevational view of a plain plug of the cassette system of FIGS. 1*a*, 1*b;*

As best seen in FIG. 1*c*, the capstan 40 has a central scalloped hole 46 on its side surface. The hole 46 defines at least one slot 48 having a maximum diameter width D. The hole 46 could bet shaped to define two different slots disposed, for example, orthogonal to each other, each having a maximum width D. As seen in FIG. 1*d*, the bushing 36 has an identical hole 46 with slots 48. The end plugs 14A, 14B are installed and oriented with holes 46 positioned coaxially with the axis of the mandrel 30 and the slots 42 on the respective end plugs disposed in parallel to each other.

Figure 2A:
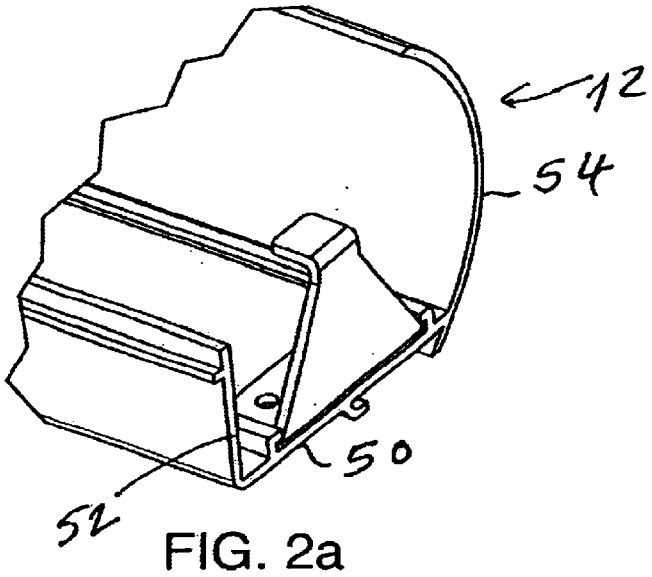
FIG. 2*a* shows a partial orthogonal view of the head rail for the cassette system of FIG. 1 as seen from the back without the blind roller and the end caps.
Figure 2B:
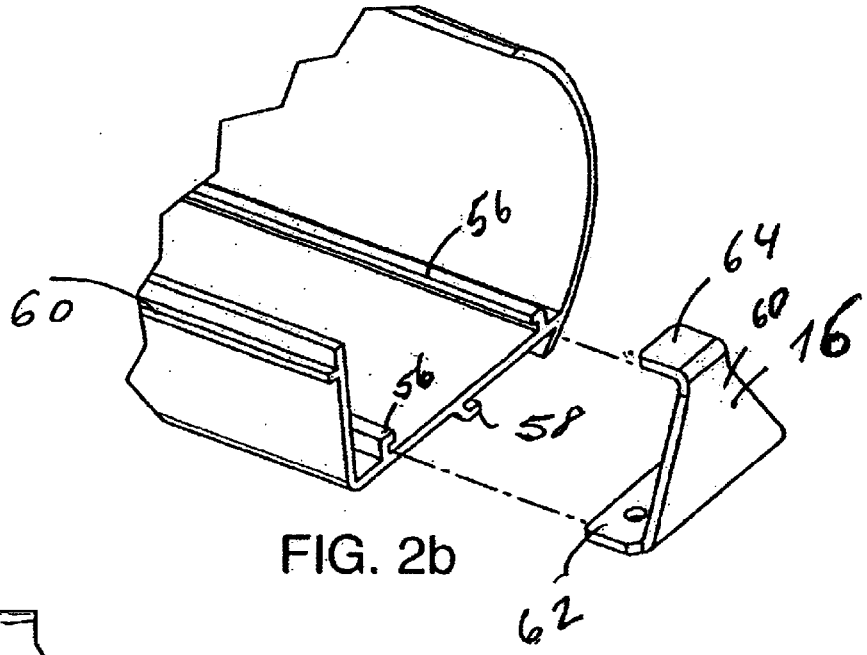
FIG. 2*b* shows the head rail of FIG. 2*a* with the end bracket removed.

FIGS. 2*a* and 2*b* show details of the head rail 12 and two end brackets 16 mounted on the head rail 12 so that they face each other. The head rail 12 is made from aluminum, an aluminum alloy and other similar rigid and relatively light weight material. The head rail is formed with a base 50, a rear wall 52 and a front wall 54. The base 50 is formed with two L-shaped internal channels 56. The two channels extend in parallel to define a track for the brackets 16. The base 50 and the rear wall 52 each have an external rib 58, 60. These external ribs are used to secure the clips 20. The clips 20 are external mounting brackets. The front wall 54 is essentially decorative and its purpose is to hide the other elements of the cassette from view.

The brackets 16 are generally C-shaped with a vertical member 60 and two legs 62, 64 oriented perpendicularly to the vertical member 60. The leg 64 has a width that corresponds to the distance between the channels 56 allowing the brackets to be inserted into the track formed by these channels, as shown in FIG. 2*b*. The leg 62 is formed with a small dimple 66 that protrudes slightly to form an interference fit with the base 50. As a result of this fit, the brackets 16 are held within the track. The leg 64 has a width that is slightly smaller than the distance D defined by the slots 48 on the end plugs 14A, 14B.

Referring back to FIG. 1, the cassette system 100 is assembled so that the brackets are inserted into the track between the rails 56 and the roller blind is supported on the legs 64 of the brackets 16. Since these legs 64 are inserted into slots 48, the bushing 36 and capstan 40 are immobilized thereby allowing the panel 32 to be raised and lowered as described above. Importantly, since the central holes 46 on the end plugs 14A, 14B are identical, the two brackets, in this example, are identical as well, thereby reducing the number of parts required, and manufacturing costs. The end caps 18 are made to press fit, as in a manually applied frictional engagement onto the head rail 12.

Figure 3:
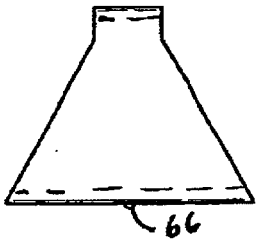
FIG. 3 shows a side elevational view of the bracket of FIG. 2*b;*
Figure 1:
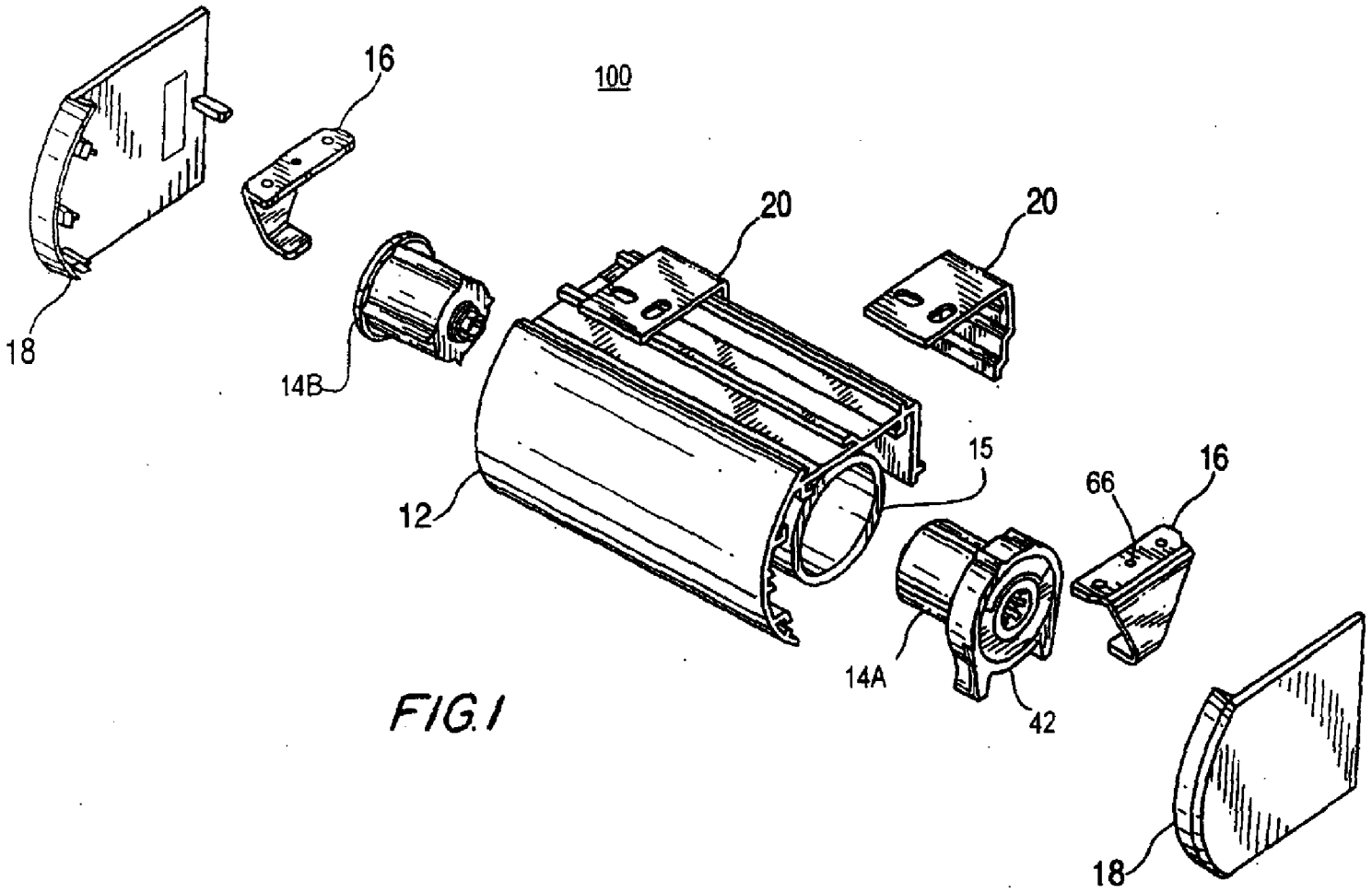
Figure 1A:
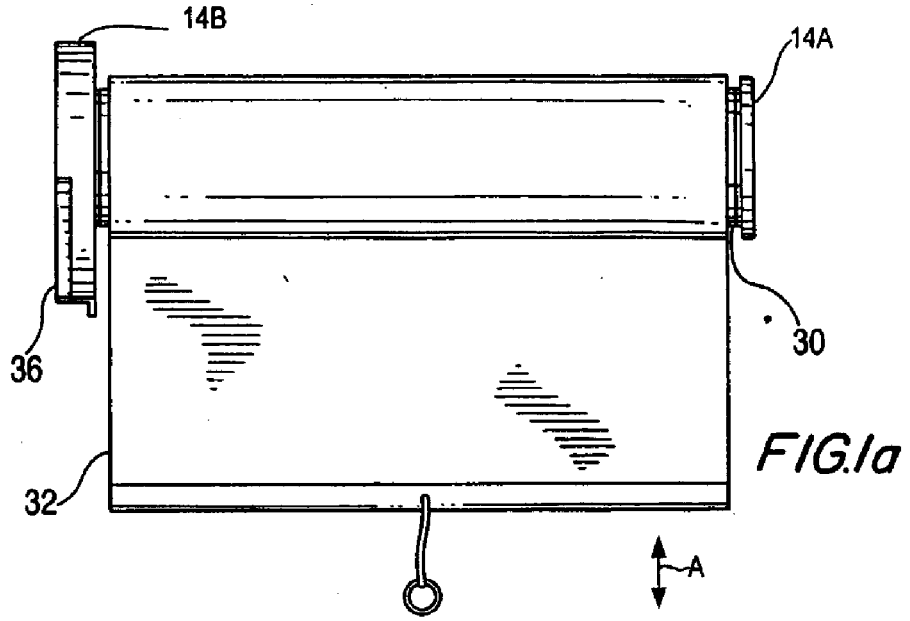
Figure 1B:
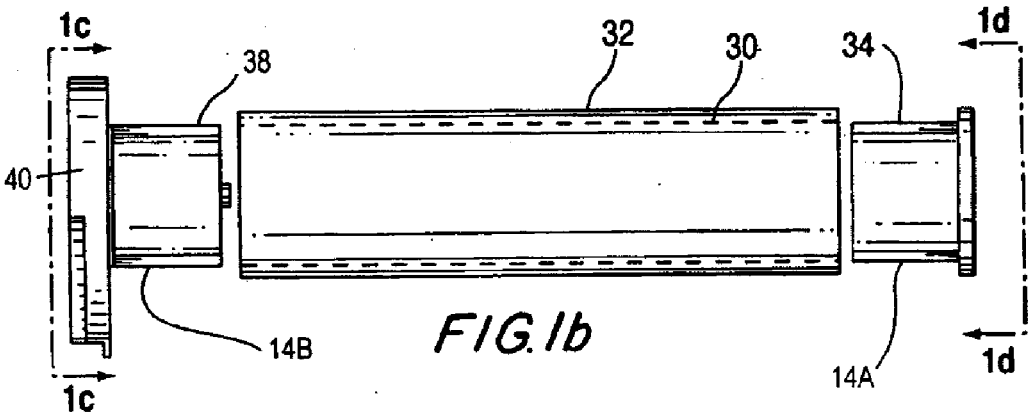
Figure 1C:
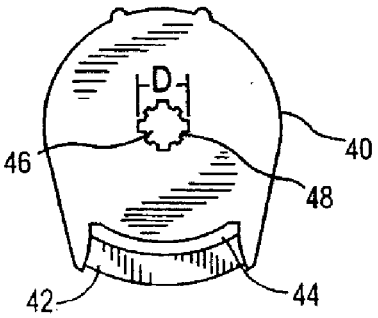
Figure 1D:
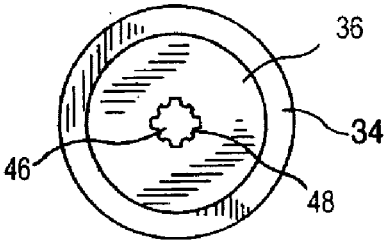
Figure 4A:
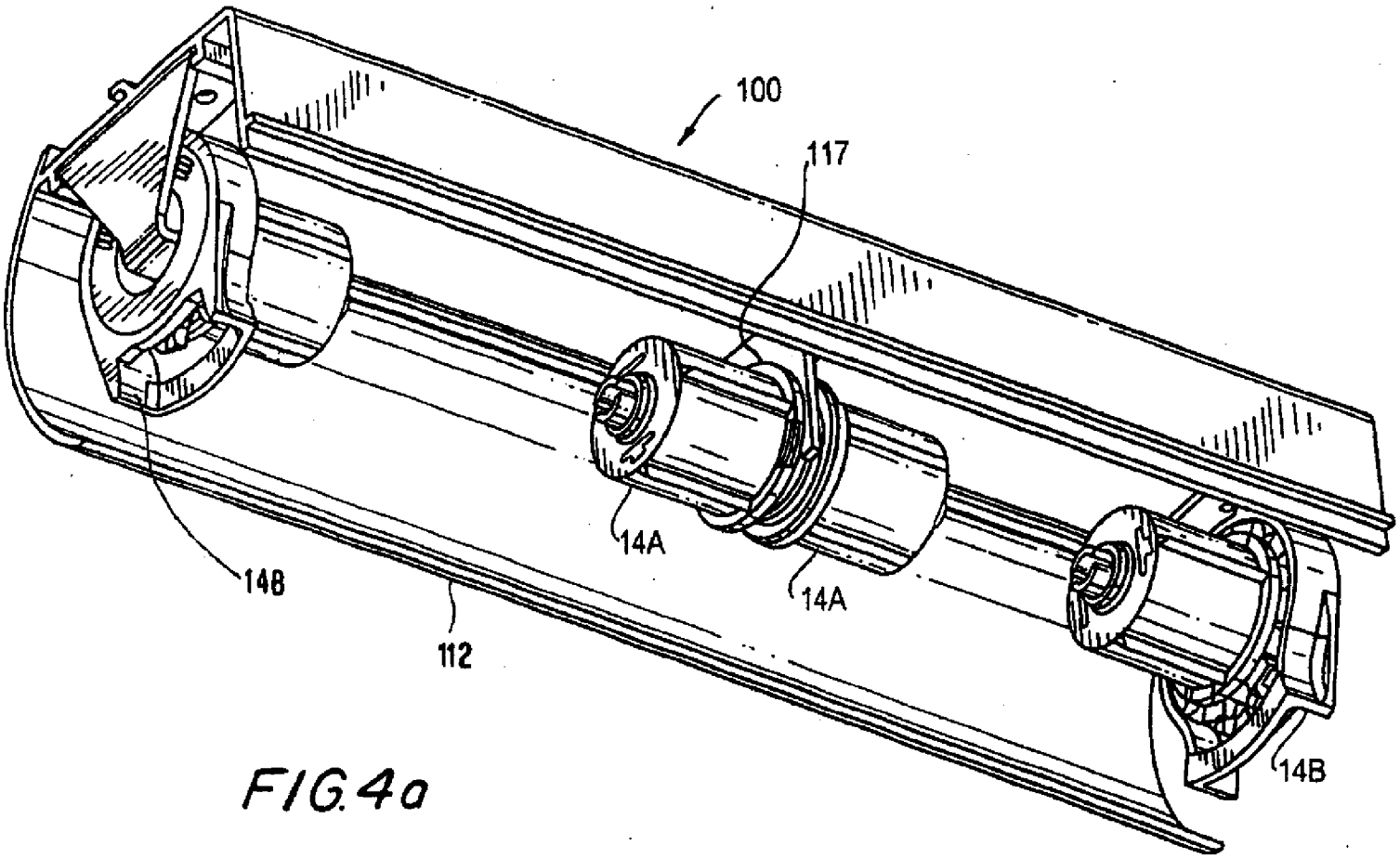
FIG. 4*a* shows an orthogonal view of a cassette system for two blind rollers.
Figure 4B:
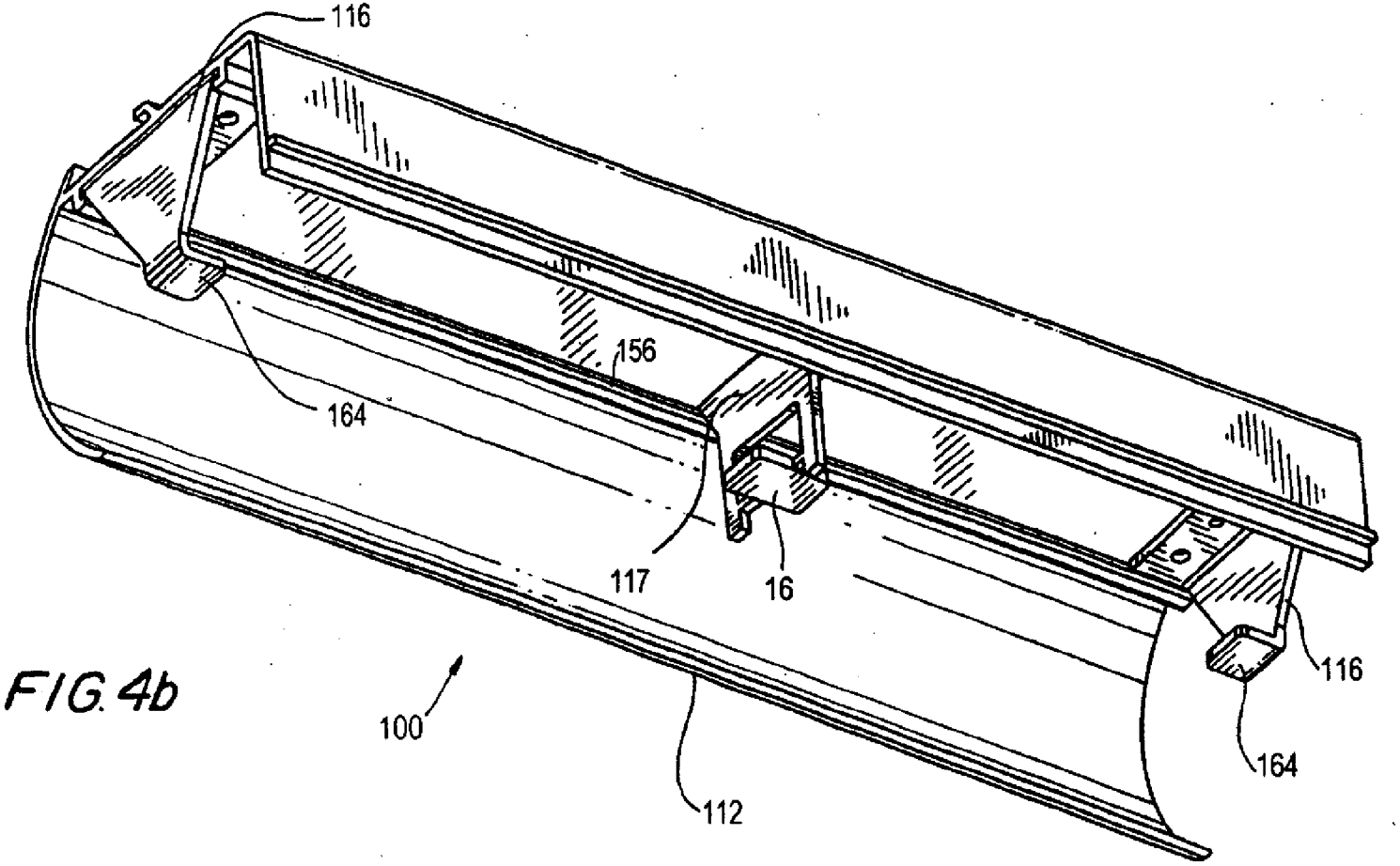
FIG. 4*b* shows an orthogonal view of the cassette of FIG. 4*a* with the end plugs removed.

FIGS. 4*a* and 4*b* show an alternate embodiment of the invention. In this embodiment, a cassette system is shown that can be used for two roller blinds disposed side by side. As can be seen in these Figures, the cassette system 100 includes a head rail 112, two end brackets. 116 and two roller blinds (not shown, but identical to the roller blind of FIGS. 1-3). Each roller blind has its own set of end plugs 14A, 14B. One end plug of each roller blind is mounted on a leg 164 of one of the end brackets 116. Importantly, the cassette system 100 further includes an intermediate bracket 117 arranged and constructed to slide within the longitudinal track formed by ribs 156. The intermediate bracket 117 has a vertical member 160 and two legs 164A and 164B oriented in the opposite directions, as shown. These legs are used to support the other two end plugs of the roller blinds. In FIG. 4*a* the end plugs 14B are shown mounted on the legs 164 while the end plugs 14A are mounted on legs 164A, 164B. The positions of the end plug can be reversed, or an alternate arrangement can be used. For example, starting in FIG. 4*a*, the leftmost end bracket can be used for an end plug 14B, the intermediate bracket 117 could be used for one end plug 14B (facing toward the left) and one end plug 14B facing toward the right, The rightmost leg 164 could then be used for an end plug 14A.

The scheme can be extended for any number of roller blinds. For this latter cassette system, two end brackets are required and a number of intermediate brackets, identical to bracket 117, are used to provide the proper support. This cassette system has several advantages as well. First, the same type of parts are used for all systems, the only difference between systems being the length of the head rail 112. A further advantage is that each roller blind can be raised and lowered independently. Finally, if individual cassette systems are used (whether identical to the system shown in FIGS. 1-3, or not) each system requires its own bracket and end cap at the interface between two adjacent systems. As a result, when the panels of each roller blinds are lowered, the horizontal spacing between these panels is substantial. Such a spacing may be esthetically undesirable. In the present invention, no end caps are required between roller blinds, and subsequently the horizontal spacing therebetween is substantially equal to the width of the intermediate bracket plus the width of the capstan 40. (The distance by which the drum 34 on end plug 14A extends axially beyond the roller 30 is negligible).

While the invention has been described with reference to several particular embodiments, it is to be understood that these embodiments are merely illustrative of the principles of the invention. Accordingly, the embodiments described in particular should be considered as exemplary, not limiting, with respect to the following claims.

We claim:

1. A cassette system comprising:

a head rail having a base with a longitudinal track;

two identical brackets inserted and supported in said longitudinal track and having a leg; and a roller blind having a first and a second end plug, said end plugs having identical slots, each slot receiving one of said legs, said first end plug including a control mechanism to control a rotation of said roller blind, said end plugs being supported by the legs of said brackets.

2. The cassette system of claim 1 wherein said end plugs are oriented with said slots being disposed in parallel to each other.

3. The cassette system of claim 1 wherein said roller blind includes a mandrel with two ends receiving, said end plugs and a panel wound on said mandrel.

4. The cassette system of claim 1 wherein said head rail further includes a front wall and a rear wall, said front wall being arranged to cover said mandrel.

5. The cassette system of claim 1 further comprising two end caps covering said brackets.

6. The cassette system of claim 1 further comprising clips attached to said head rail for mounting said cassette.

7. The cassette system of claim 1 further comprising a friction member forming an interference fit between said longitudinal track and said brackets.

8. The cassette system of claim 7 wherein said friction member is formed integrally in said brackets.

9. The cassette system of claim 1 wherein each bracket is C-shaped and includes a track leg disposed in said track and an end leg mating with one of said end plugs.

10. A cassette system for window treatment comprising:

a head rail having a base with a longitudinal track;

a first end bracket movably disposed in said track and having an end leg;

a second end bracket disposed in said track and having an end leg facing the end leg of said first end bracket;

an intermediate bracket movably disposed in said track and having a vertical member with two intermediate legs extending in opposite directions from said vertical member;

a first roller blind; and a second roller blind;

said first roller blind being supported by the end leg of said first end bracket and an intermediate leg of said intermediate bracket, and said second roller blind being supported by the end lea of said second end bracket and the other intermediate leg of said intermediate bracket.

11. The cassette system of claim 10 wherein said first and second end brackets have identical shapes.

12. The cassette system of claim 10 wherein each roller blind has a clutch end plug and a plain end plug, said end plugs receiving the respective leg to support said roller blinds.

13. The cassette system of claim 7 wherein each roller blind has two end plugs and each end plug is formed with a slot, all the slots of the end plugs being substantially identical and each bracket is formed with substantially identical legs, said legs mating with the respective slots.

14. The cassette system of claim 10 wherein said head rail includes a back wall and a front wall forming a tubular housing for said roller blind.

15. The cassette system of claim 14 wherein further comprising two end caps covering said brackets.

16. The cassette system of claim 10 further comprising clips attached to said head rail for mounting said cassette.

17. The cassette system of claim 10 further comprising a friction member forming an interference fit between said longitudinal track and said brackets.

18. The cassette system of claim 17 wherein said friction member is formed integrally in said brackets.

19. The cassette system of claim 10 wherein each end bracket is C-shaped leg and includes a track leg disposed in said track and an end leg mating with one of said end plugs.

20. A cassette system comprising:

a head rail with a base formed with a longitudinal track;

two end brackets each having an end leg and at least one intermediate bracket with a vertical member with two intermediate legs, said brackets being movably disposed in said track; and at least two roller blinds having end plugs, said roller blinds being supported in a colinear arrangement between said brackets, with said legs and end plugs cooperating to allow independent operation of said roller blinds.

21. The cassette system of claim 20 wherein said end plugs are formed with slots and said legs being arranged to be received in said slots.

22. The cassette system of claim 21 wherein said end wherein said end legs and said intermediate legs are substantially identical.

23. The cassette system of claim 20 further comprising end caps covering said end brackets.

24. The cassette system of claim 20 wherein said end brackets are identical.

* * * * *

UNITED STATES PATENT AND TRADEMARK OFFICE

CERTIFICATE OF CORRECTION

PATENT NO. : 6,817,402 B1 
DATED : November 16, 2004
INVENTOR(S) : Richard Fraczek, David M. Cross and Jeffrey Ausfeld It is certified that error appears in the above-identified patent and that said Letters Patent is hereby corrected as shown below:

Replace formal drawings with attached.

Signed and Sealed this

Tenth Day of May, 2005

JON W. DUDAS
*Director of the United States Patent and Trademark Office*

(12) United States Patent
Fraczek et al.

(10) Patent No.: US 6,817,402 B1
(45) Date of Patent: Nov. 16, 2004

(54) UNIVERSAL BRACKETING AND CAP SYSTEM FOR MULTIPLE CASSETTE ROLLER SHADE

(75) Inventors: Richard Fraczek, Stamford, CT (US); David M. Cross, Westport, CT (US); Jeffrey Ausfeld, New York, NY (US)

(73) Assignee: Rollease, Inc., Stamford, CT (US)

( * ) Notice: Subject to any disclaimer, the term of this patent is extended or adjusted under 35 U.S.C. 154(b) by 0 days.

(21) Appl. No.: 10/391,003

(22) Filed: Mar. 18, 2003

Related U.S. Application Data

(60) Provisional application No. 60/366,318, filed on Mar. 21, 2002.

(51) Int. Cl.[7] ..... A47G 5/02

(52) U.S. Cl. ..... 160/323.1; 248/267

(58) Field of Search ..... 160/321, 326, 160/23.1, 24, 323.1, 120, 241; 248/266, 267

(56) References Cited

U.S. PATENT DOCUMENTS 1,545,160 A * 7/1925 Myers ..... 248/266
4,122,559 A * 10/1978 Kelly ..... 4/608
4,231,411 A * 11/1980 Hehl et al. ..... 160/120
4,372,432 A 2/1983 Waine et al.
4,433,765 A 2/1984 Rude et al.
5,975,186 A * 11/1999 Day ..... 160/321
6,173,825 B1 * 1/2001 Liu ..... 192/223.4
6,457,688 B1 * 10/2002 Welfonder ..... 248/266
6,499,709 B1 * 12/2002 Parent ..... 248/267
6,532,109 B1 * 3/2003 Shopp ..... 359/461

* cited by examiner

*Primary Examiner*—Blair M. Johnson
(74) *Attorney, Agent, or Firm*—Jeffrey M. Kaden, Esq.; Gottlieb, Rackman & Reisman, P.C.

(57) ABSTRACT

A cassette system for window treatment includes a head rail with a base, end brackets attached to the base in a facing relationship and at least one roller blind with a mandrel and a decorative panel that is wound on the mandrel. The panel can be selectively drawn off the mandrel by rotation thereof. The end brackets are identical and mate with end plugs on the mandrel to rotationally support the roller blind. In an alternate embodiment, two or more roller blinds are supported by intermediate brackets or by an intermediate bracket and an end bracket. The end plugs on the madrel(s) have identical shapes to mate with respective legs on the end brackets.

24 Claims, 5 Drawing Sheets

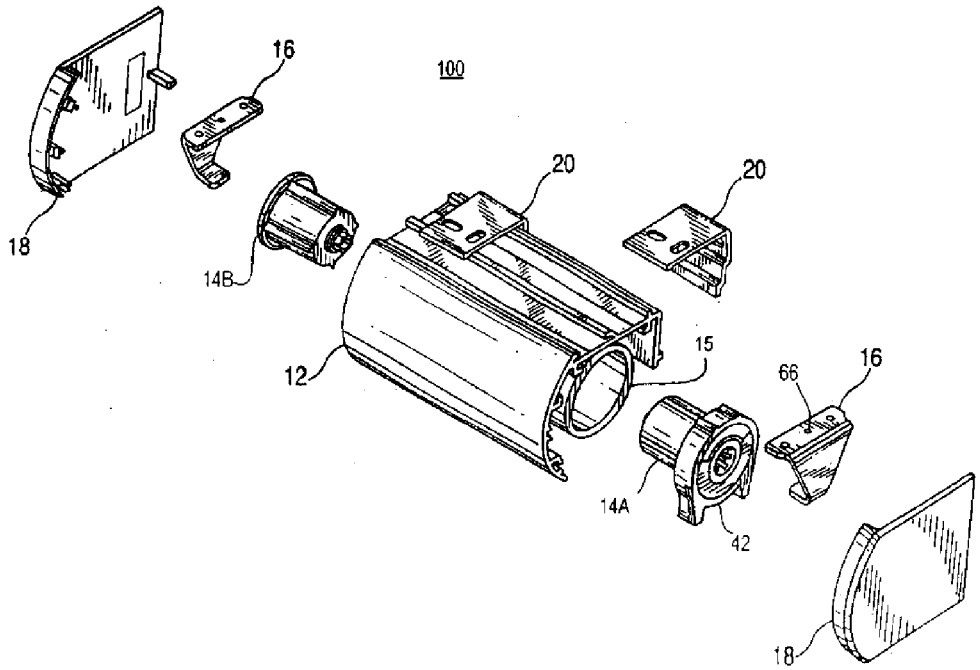

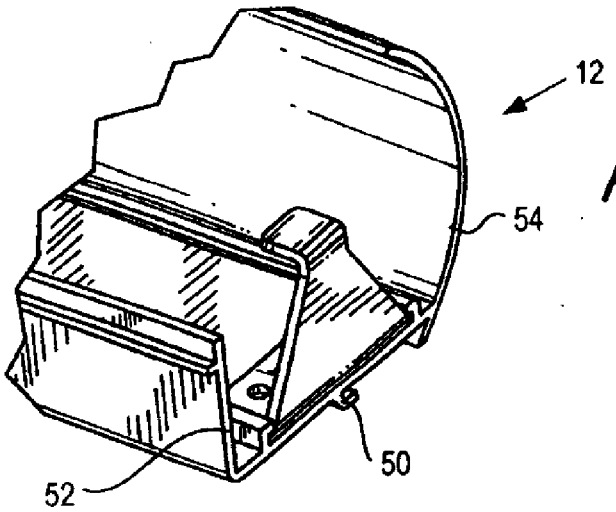
FIG. 2a
FIG. 2b
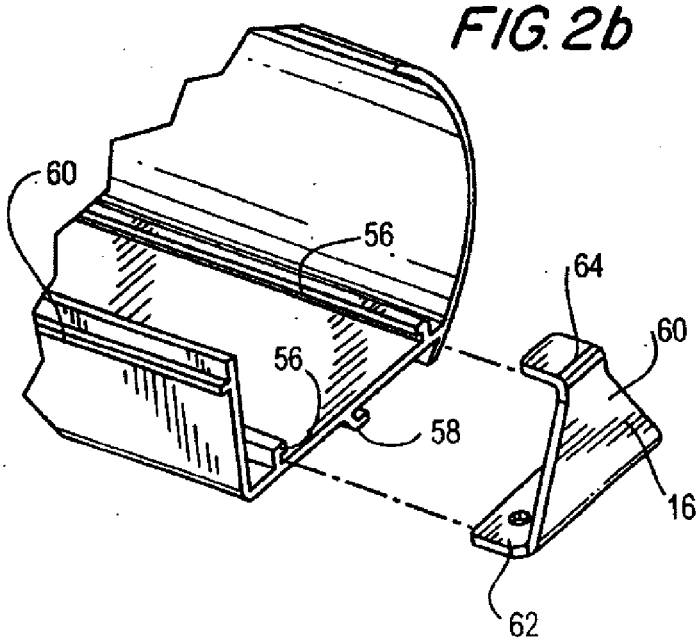
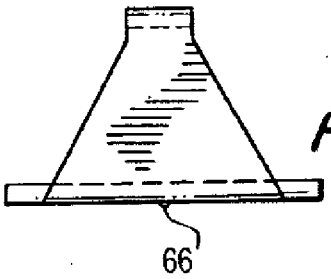
FIG. 3